US007238036B2

(12) United States Patent
Sato et al.

(10) Patent No.: US 7,238,036 B2
(45) Date of Patent: Jul. 3, 2007

(54) CONNECTOR

(75) Inventors: Kei Sato, Shizuoka (JP); Kazuki Zaitsu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/509,561

(22) Filed: Aug. 25, 2006

(65) Prior Publication Data

US 2007/0049091 A1 Mar. 1, 2007

(30) Foreign Application Priority Data

Aug. 31, 2005 (JP) ..... 2005-250970

(51) Int. Cl.
*H01R 33/02* (2006.01)

(52) U.S. Cl. ..... 439/236; 439/936

(58) Field of Classification Search ..... 439/276, 439/936, 902; 736/736; 174/76
See application file for complete search history.

(56) References Cited

U.S. PATENT DOCUMENTS 4,335,932 A * 6/1982 Herrmann, Jr. ..... 439/587
5,199,089 A * 3/1993 Campbell et al. ..... 385/24
5,462,622 A * 10/1995 Small et al. ..... 156/245
5,703,754 A * 12/1997 Hinze ..... 361/736
6,582,249 B1 * 6/2003 Boeck et al. ..... 439/492
6,913,493 B2 * 7/2005 Berg et al. ..... 439/736
6,926,540 B1 * 8/2005 Juntwait ..... 439/76.1
7,048,564 B1 * 5/2006 Hinze ..... 439/276

FOREIGN PATENT DOCUMENTS

JP 2001-76808 3/2001

* cited by examiner

*Primary Examiner*—Tulsidas C. Patel
*Assistant Examiner*—Phuongchi Nguyen
(74) *Attorney, Agent, or Firm*—Armstrong, Kratz, Quintos, Hanson & Brooks LLP

(57) ABSTRACT

The present invention is to provide a connector having watertight between a cover and a housing, and preventing a filler from leaking out of fitting faces therebetween. The housing has a housing groove, at a side of the cover, defined with a first and second housing walls. The cover has a cover groove, at a side of the housing, defined with a first and second cover walls. When the cover is attached to the housing, a first and second thin end portions of the first and second cover walls enter into the housing groove to form a filling space of the filler around a connector block of the housing. The filler injected into the filling space expands and presses the first and second thin end portions to deform and closely abut the first and second housing walls.

4 Claims, 9 Drawing Sheets

CONNECTOR

BACKGROUND OF THE INVENTION

1. Field of the Invention

The present invention relates to a connector for connecting an electric wire.

2. Description of the Related Art

A motor vehicle has a wire harness, which bundles a plurality of electric wires, for sending electric power and control signal to a variety of electronic devices. The wire harness has a connector at an end thereof for connecting to the variety of the electronic devices.

JP, 2001-76808, A discloses a waterproof connector utilized in a place, where rain water enters into, such as an engine room.

The waterproof connector is connected to a connector connected with the electronic devices in the engine room to send the control signal.

The waterproof connector includes a terminal connected with an end portion of an electric wire, a housing having a terminal receiver receiving the terminal, and a cover attached to the housing.

The housing and cover have box shapes and are made of an insulation synthetic resin. The attachment of the cover to the housing protects a connection portion of the terminal in the housing. The housing attached with the cover has a filling groove for a filler to be injected.

The filler injected into the connector keeps watertight between the cover and housing, and prevents the rain water from entering into the housing from outside the connector.

The connector with the housing and cover described above is resin molded and often causes a dimension error at the molding. Hence, when the cover is attached to the housing, a small gap occurs at a fitting face therebetween. In this situation, when the filler is injected into the filling groove, the filler leaks out of the gap.

The filler leaked out enters into the terminal receiver in the housing and causes a contact failure of the terminal. The filler may leak out to outside the housing and impair an appearance of the connector.

SUMMARY OF THE INVENTION

An object of the present invention is to provide a connector having watertight between a cover and housing and preventing a filler from leaking out through a fitting face therebetween.

According to a first aspect of the present invention, a connector includes: a housing receiving a connector block having a terminal receiver receiving a terminal; and a cover for covering an opening of the connector block when the cover is attached to the housing, wherein the housing has a housing groove formed, at a side of the cover, with a first housing wall and a second housing wall adjacent to the first housing wall and the cover has a cover groove formed, at a side of the housing, with a first cover wall and a second cover wall adjacent to the first cover wall, and wherein when the cover is attached to the housing, a first and second end portions of the first and second walls of one of the cover and the housing enter into the groove of the other and form a filling space of a filler around the connector block of the housing, and the filler injected into the filling space expands with a liquid pressure and presses the first and second end portions of the one to deform and closely abut to the first and second walls of the other.

Preferably, the cover has an outer cover and an inner cover, wherein the outer cover is attached to a periphery of the housing and has the first cover wall, and the inner cover received in the outer cover covers the opening of the connector block and has the second cover wall and an opening for leading out an electric wire attached to the terminals, and wherein the filler is injected to cover fully the inner cover.

Preferably, the housing and cover have respective housing and cover lead-out portions for leading out the electric wire attached to the terminals through a lead-out hole, at least one of the housing and cover lead-out portions has a wire holder upstanding at the second wall and facing to an inner side of the lead-out hole for holding the electric wire, and wherein the filler is injected through the lead-out hole.

Preferably, the filler is an effervescent resin.

DETAILED DESCRIPTION OF THE PREFERRED EMBODIMENTS

Figure 1:
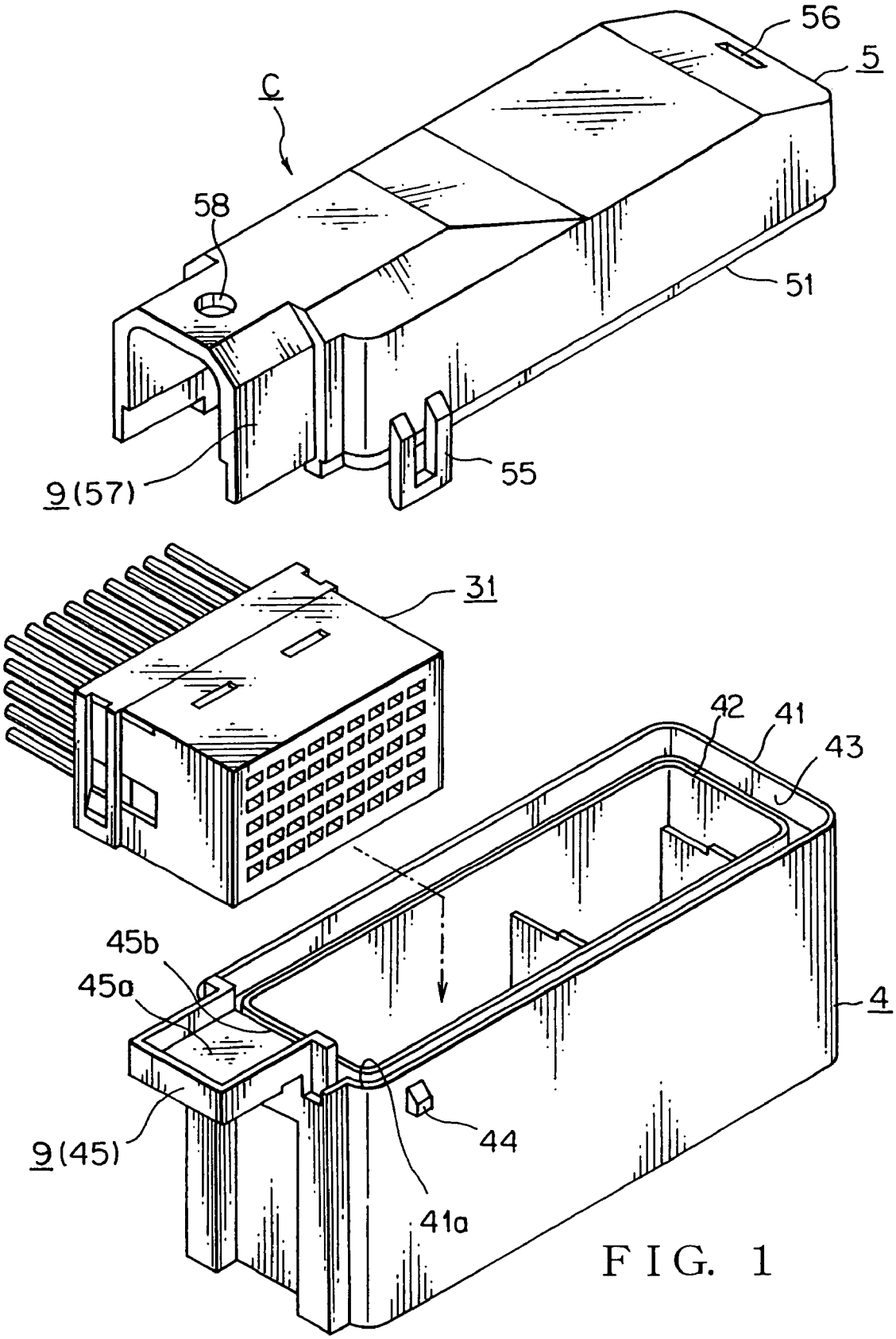
FIG. 1 is an exploded perspective view showing a connector of a first embodiment of the present invention.

A connector of a first embodiment of the present invention is explained by referring to FIGS. 1–7.

As shown in FIGS. 1–4, a connector C includes terminals 2 connected to end portions of electric wires 1, a housing 4 receiving a connector block 31, which has terminal receivers 3 to receive the terminals 2, and a cover 5 to be attached to the housing 4 and to cover an opening of the connector block 31.

The housing 4 is made of an insulation synthetic resin and has a tube shape. The housing 4 receives the connector block 31.

The housing 4 has a first housing wall 41 and a second housing wall 42. The first housing wall 41 is formed in a tube shape and disposed in a periphery of the housing 4. The second housing wall 42 is disposed inside the first housing wall 41 adjacent to the first housing wall 41. The first and second housing walls. 41 and 42 are formed coaxially. The connector block 31 is received inside the second housing wall 42.

Figure 2:
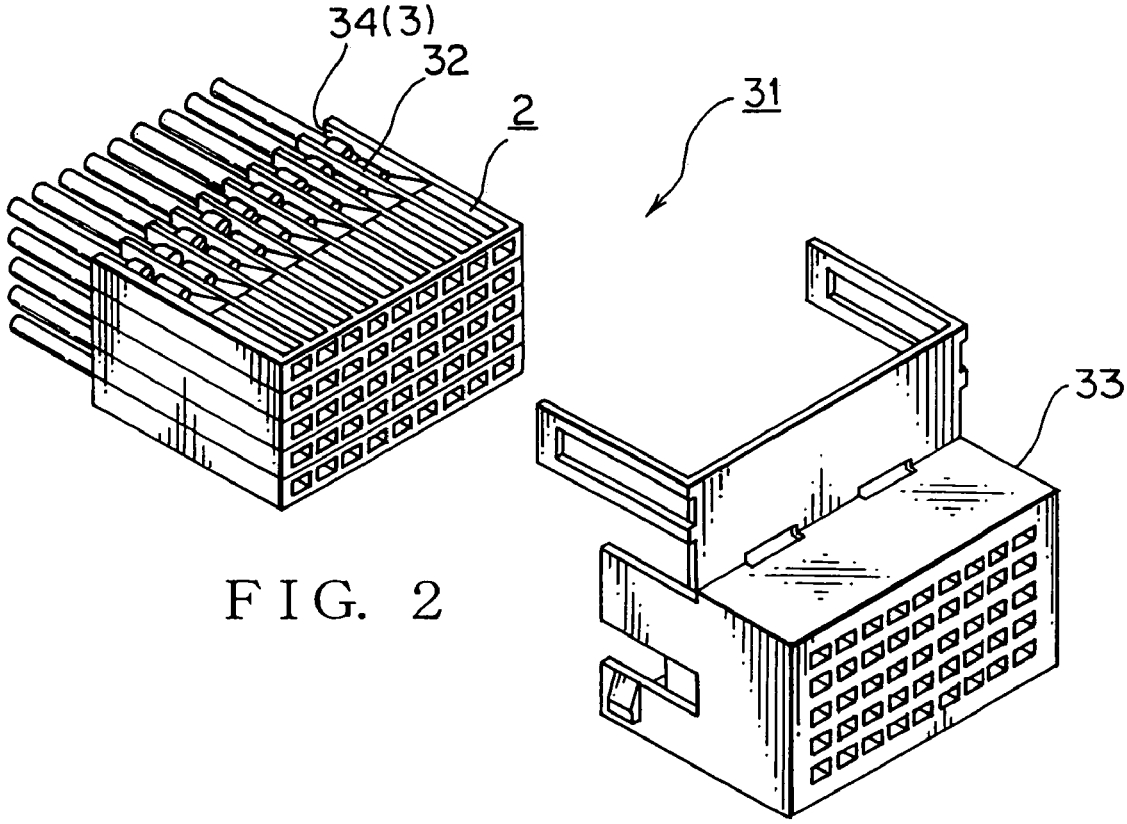
FIG. 2 is an exploded perspective view showing a connector block received in the connector.

As shown in FIG. 2, the connector block 31 has a collection of terminal receiving plates 32 and a holder 33. The collection of the terminal receiving plates 32 have a plurality of cavities 34 for receiving the terminals 2 and is attached to the holder 33 to assemble the connector block 31.

Figure 4:
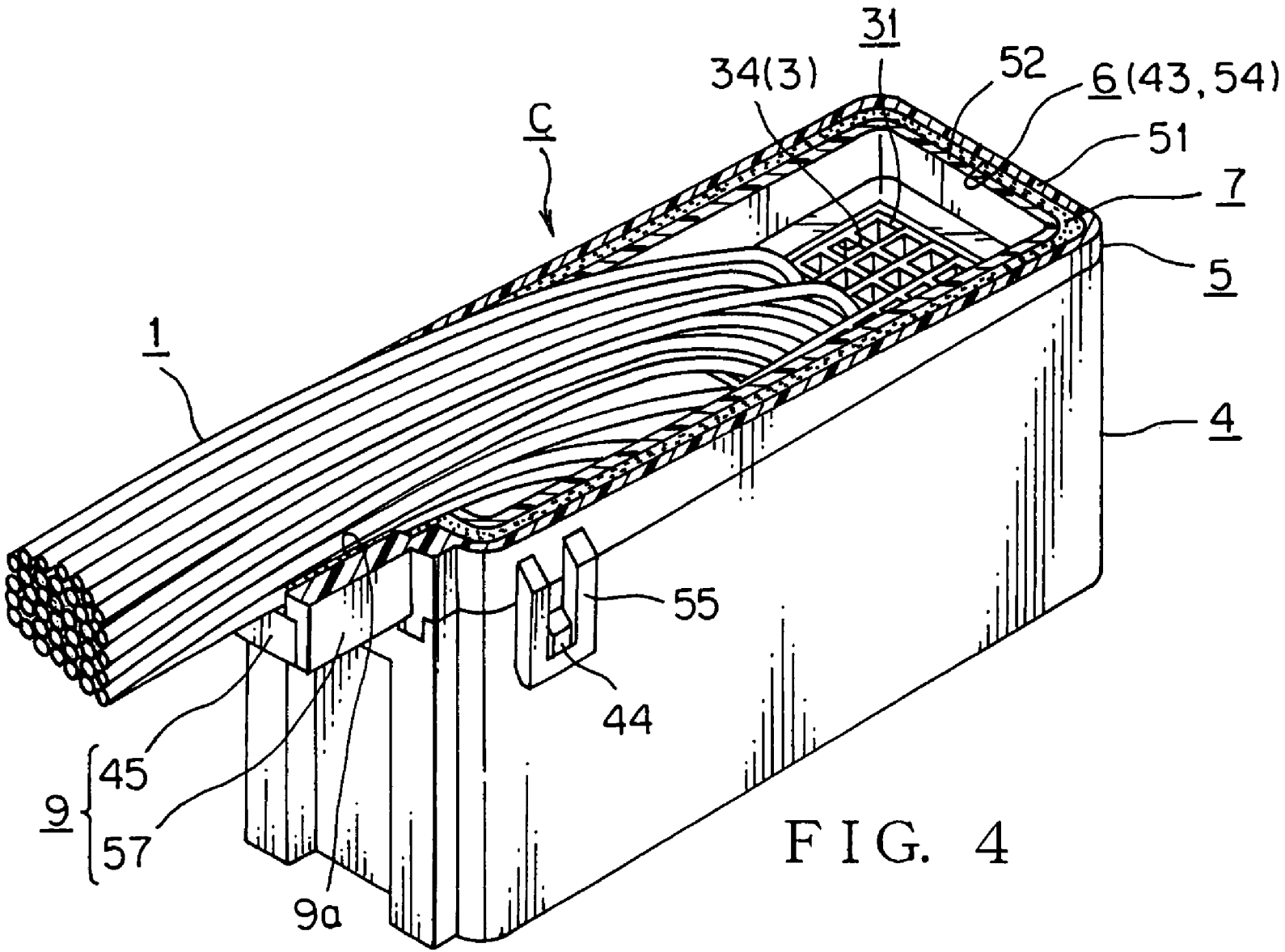
FIG. 4 is a horizontal sectional view taken along lines 4—4 of FIG. 3 for illustrating an assembling of the connector.
Figure 5:
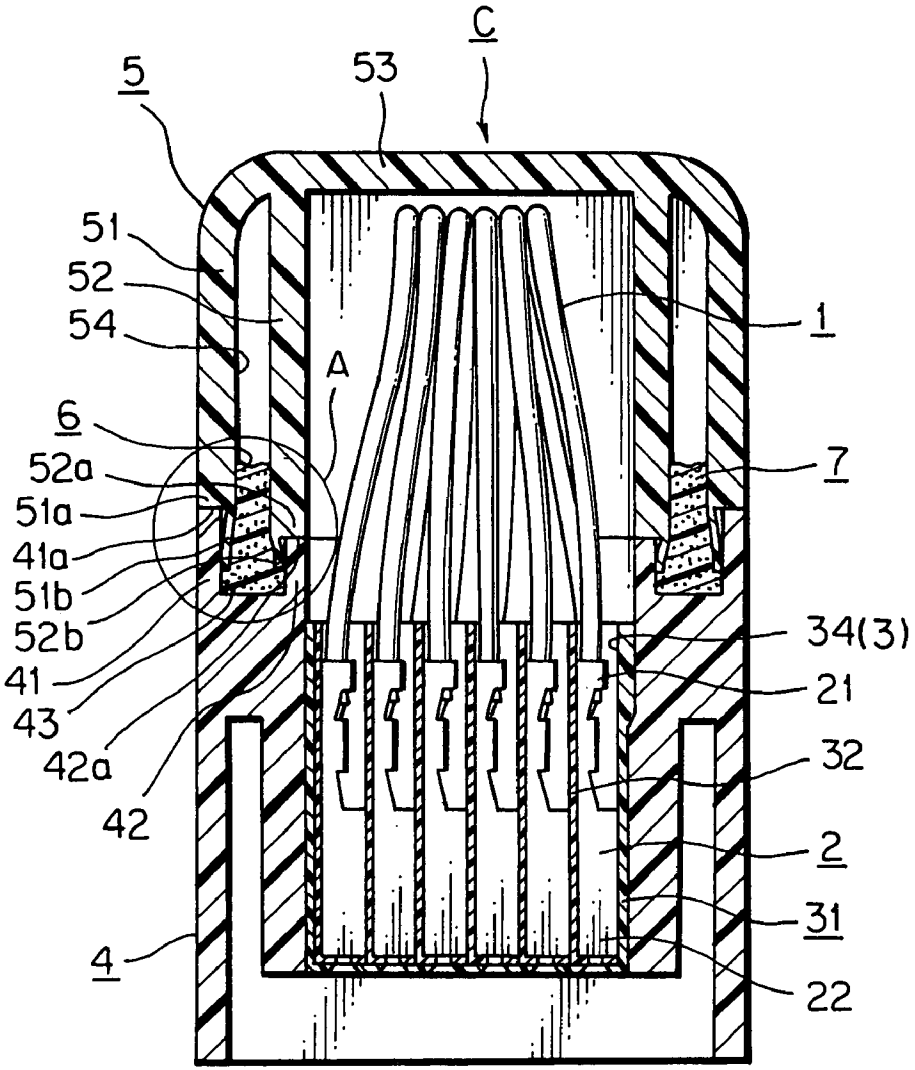
FIG. 5 is a vertical sectional view taken along lines 5—5 of FIG. 3 for illustrating the assembling of the connector.

As shown in FIG. 4, the cavities 34 penetrate through inside the connector block 31 vertically received in the housing 4. The female type terminals 2 are received in the cavities 34 as shown in FIG. 5.

The terminals 2 are formed by punching out a conductive metal plate and have electric wire connection portions 21, hereafter referred to wire connection portion, and electric contact portions 22. The wire connection portions 21 crimp the end portions of the electric wires 1 of the wire harness arranged in the motor vehicle. The electric contact portions 22 have a tube shape and receive end portions of male type terminals, not shown, as the female type terminals.

The connector block 31 receiving the plurality of the female type terminals 2 in the cavities 34 is received in the housing 4 so that the connector C having the densely packed terminals 2 is assembled. The connector C is fitted to a connector, not shown, of the electronic devices in the engine room of the motor vehicle. The connector of the electronic devices have the male type terminals, not shown, to be fitted to the female type terminals 2 of the connector C.

The cover 5 is attached to the housing 4 to cover the opening of the cavities 34 of the connector block 31.

The housing 4 has the first housing wall 41 as the peripheral wall and the second housing wall 42 inside the first housing wall 41. As shown in FIG. 5, the housing 4 has a housing groove 43 with a U-shaped section, which is defined with the first and second housing walls 41 and 42, at an end portion thereof at a side of the cover 5.

As shown in FIG. 4, the housing groove 43 is disposed around the connector block 31 received in the housing 4. As shown in FIG. 5, a first end face 41*a* of the first housing wall 41 is positioned higher than a second end face 42*a* of the second housing wall 42.

As shown in FIG. 5, the cover 5 includes a first cover wall 51, a second cover wall 52, and a bottom wall 53. The first cover wall 51 is tube shaped and formed as a peripheral wall. The second cover wall 52 is tube shaped and disposed coaxially inside the first cover wall 51. The bottom wall 53 closes end portions of the first and second cover walls 51 and 52, and is disposed opposite to the housing 4.

The cover 5 has a cover groove 54 with a U-shaped section defined with the first and second cover walls 51 and 52.

Figure 6:
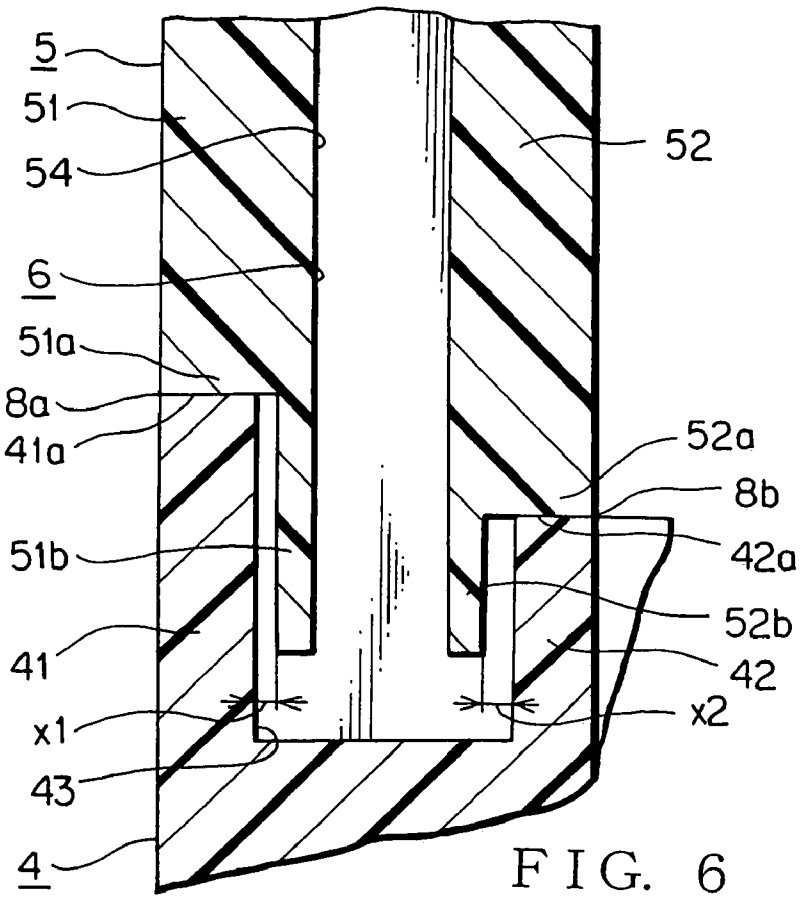
FIG. 6 is an expanded view of a portion of A of FIG. 5 prior to injecting a filler.

As shown in FIG. 6, the first and second cover walls 51 an 52 have a first and second step portions 51*a* and 52*a*, and a first and second thin end portions 51*b* and 52*b* extending from the step portions, respectively. When the cover 5 is attached to the housing 4, the first and second step portions 51*a* and 52*a* of the cover S abut to the first and second end faces 41*a* and 42*a* of the housing 4, respectively and the thin end portions 51*b* and 52*b* enter into the housing groove 43. On this occasion, gaps x1 and x2 are formed between the first housing wall 41 and the first thin end portion 51*b* and between the second housing wall 42 and the second thin end portion 52*b*, respectively.

Accordingly, the housing groove 43 and cover groove 54 are integrally formed. The first and second cover walls 51 and 52 define a filling space 6 for the filler around the connector block 31. The filling space 6 is to be filled with an effervescent filler 7 such as a two-part type urethane resin.

Figure 7:
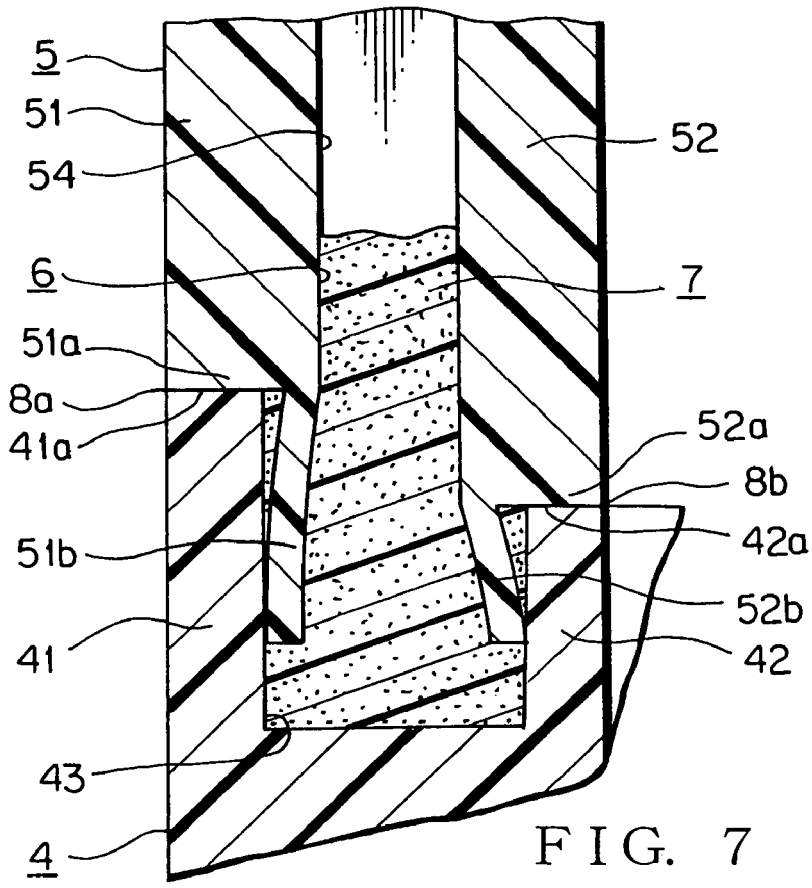
FIG. 7 is the expanded view of the portion of A of FIG. 5 after injecting the filler.

The filler 7 expands in the filling space 6 with a liquid pressure thereof and presses the first and second thin end portions 51*b* and 52*b* of the cover 5 to deform and closely abut to the first and second walls 41 and 42 of the housing 4, as shown in FIG. 7.

Accordingly, the gaps x1 and x2 are closed with the first and second thin end portions 51*b* and 52*b*. The filler 7 hardens after a prescribed time so that the housing 4 and cover 5 become watertight with the assembling.

The first and second step portions 51*a*, 52*a* and first and second end faces 41*a*, 42*a* form a first and second fitting faces 8*a*, 8*b*, respectively when the cover 5 is attached to the housing 4.

Since the first and second thin end portions 51*b* and 52*b* of the cover 5 have a close contact with the first and second walls 41 and 42 of the housing 4, the filler 7 does not leak out through the first and second fitting faces 8*a* and 8*b* even there are gaps at the fitting faces 8*a* and 8*b*.

An amount of deformation of the first and second thin end portions 51*b* and 52*b* depend on lengths and thicknesses thereof and the liquid pressure of the filler 7.

Figure 3:
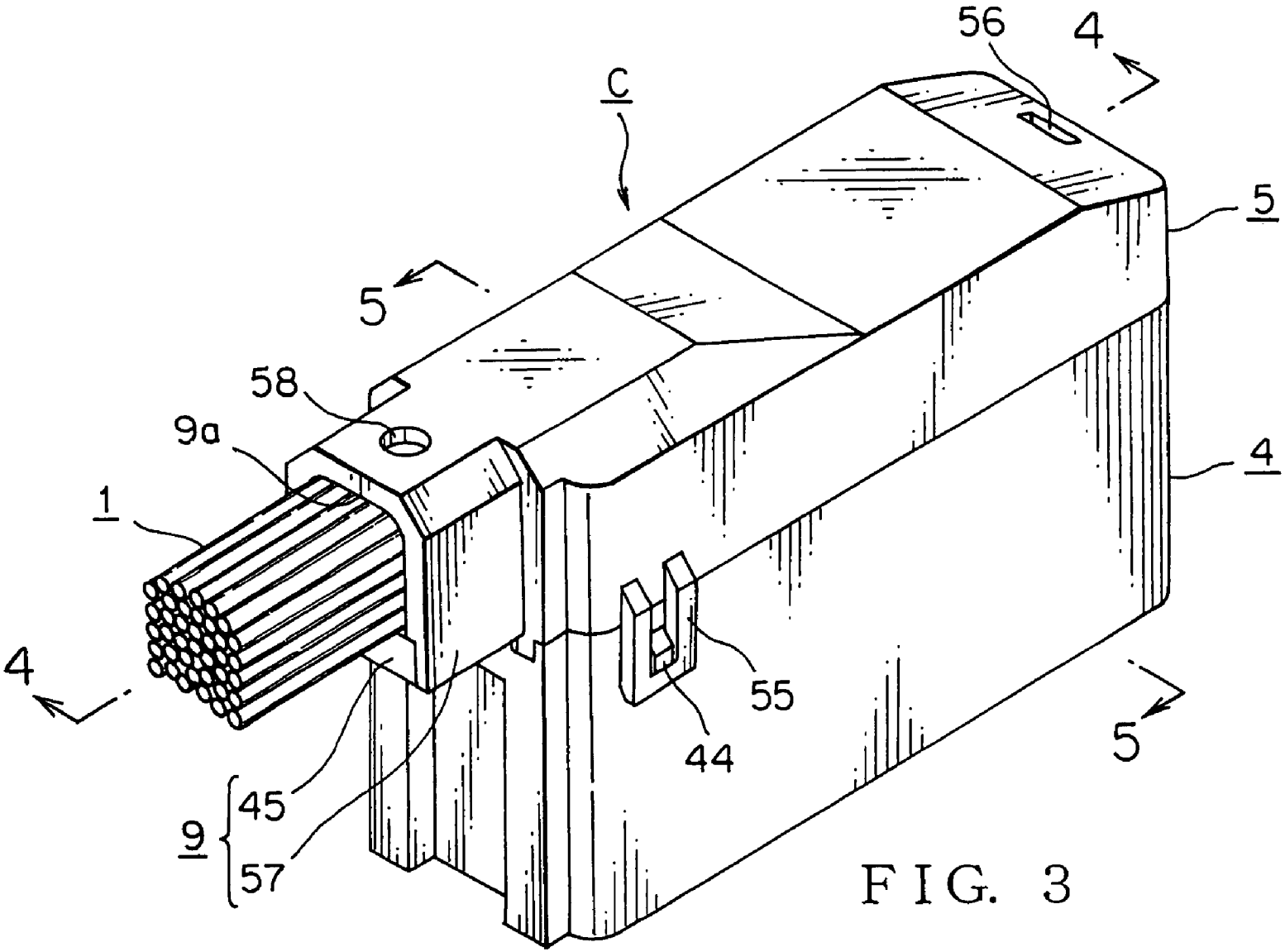
FIG. 3 is an overall perspective view of the connector.

As shown in FIG. 3, hooks 55 disposed on the cover 5 and locking portions 44 of the housing 4 are engaged each other to keep the assembling of the housing 4 and cover 5.

The cover 5 has an outlet hole 56 for discharging air in the filling space 6 so as to make a smooth flow of the filler 7.

As shown in FIGS. 3 and 4, a bundle of the electric wires 1 connected to the terminals 2 received in the connector block 31 are led out from a lead-out hole 9*a* of a lead-out portion 9, which is formed with the housing 4 and cover 5.

The lead-out portion 9 has a supporting plate 45 (housing lead-out portion) and a U-shaped portion 57 (cover lead-out portion). The supporting plate 45 is extended from the first housing wall 41 and the U-shaped portion 57 is extended from the first cover wall 51. The supporting plate 45 supports the electric wires 1 led out from the connector C and the U-shaped portion 57 covers around the electric wires 1.

As shown in FIG. 1, an inner face 45*a* of the supporting plate 45 of the housing 4 is positioned to the same height as the first end face 41*a* of the first housing wall 41. A step portion 45*b* is formed between the supporting plate 45 and the housing groove 43. The cover 5 has an injection hole 58 at the U-shaped portion 57 for injecting the filler 7.

In order to assemble the connector C, the connector block 31 is firstly received inside the second housing wall 42. The terminals 2 connected with the end portions of the electric wires 1 are inserted into the cavities 34 of the connector block 31. The bundle of the electric wires 1 connected to the terminals 2 is put on the supporting plate 45 of the housing 4. The cover 5 is attached to the housing 4.

As described above, the first and second step portions 51*a* and 52*a* of the cover 5 abut to the first and second end faces 41*a* and 42*a*, respectively and the first and second thin end portions 51*b* and 52*b* enter into the housing groove 43. Accordingly, the housing groove 43 and the cover groove 54 are integrally formed for defining the filling space 6 of the filler 7.

The cover 5 is attached to the housing 4 with the hooks 55 and locking portions 44. The electric wires 1 led out are covered with the U-shaped portion 57 of the cover 5.

The effervescent filler 7 such as the two-part type urethane resin is injected through the injection hole 58 of the U-shaped portion 57. The effervescent filler 7 has a high flowability right after injection and easily enters into a narrow gap but becomes hard after a prescribed time.

The filler 7 injected flows around the bundle of the electric wires 1 and between the electric wires 1 and flows toward the supporting plate 45. The filler 7 further flows to the inner face 45*a* and the step portion 45*b* and flows into housing groove 43. Accordingly, the filling space 6 disposed around the connector block 31 is filled with the filler 7.

The filler 7 filled in the filling space 6 is effervescent so that it expands in the filling space 6 and deforms the first and second thin end portions 51*b* and 52*b* to abut to the first and second housing walls 41 and 42. Accordingly, the gaps x1 and x2 are closed.

After the prescribed time, the filler 7 hardens so that the connector C becomes watertight between the housing 4 and the cover 5.

The filler 7 filled and hardened around the bundle of the electric wires 1 and among the electric wires 1 also keep the lead-out portion 9 watertight.

Since the gaps x1 and x2 are closed, the filler 7 does not leak out of the fitting faces 8*a* and 8*b*. Accordingly, the filler 7 does not enter into the connector block 31 so that the electrical connection of the terminals 2 are maintained. The filler 7 does not also leak out outside the housing so that the appearance of the connector C is kept.

The deformation of the first and second thin end portions 51*b* and 52*b* of the cover 5 keeps watertight between the housing 4 and cover 5 so that it is unnecessary to utilize a special member such as a packing, and a number of parts and a cost thereof are reduced.

In the embodiment of the present invention, the first and second thin end portions 51*b* and 52*b* enter into the housing groove 43 to form the filling space 6. End portions of the first and second housing walls 41 and 42 may enter into the cover groove 54 to form the filling space 6.

In this case, the liquid pressure of the filler 7 presses the end portions of the first and second housing walls 41 and 42 to closely abut to the first and second cover walls 51 and 52. Accordingly, the connector C becomes watertight between the cover 5 and the housing 4. Gaps formed at the fitting faces between the cover 5 and housing 4 due to a dimension error are assuredly prevented the filler 7 from leaking out therefrom.

The filler 7 is not limited to the effervescent urethane resin but may utilize any effervescent resin which hardens after injecting the material.

Figure 8:
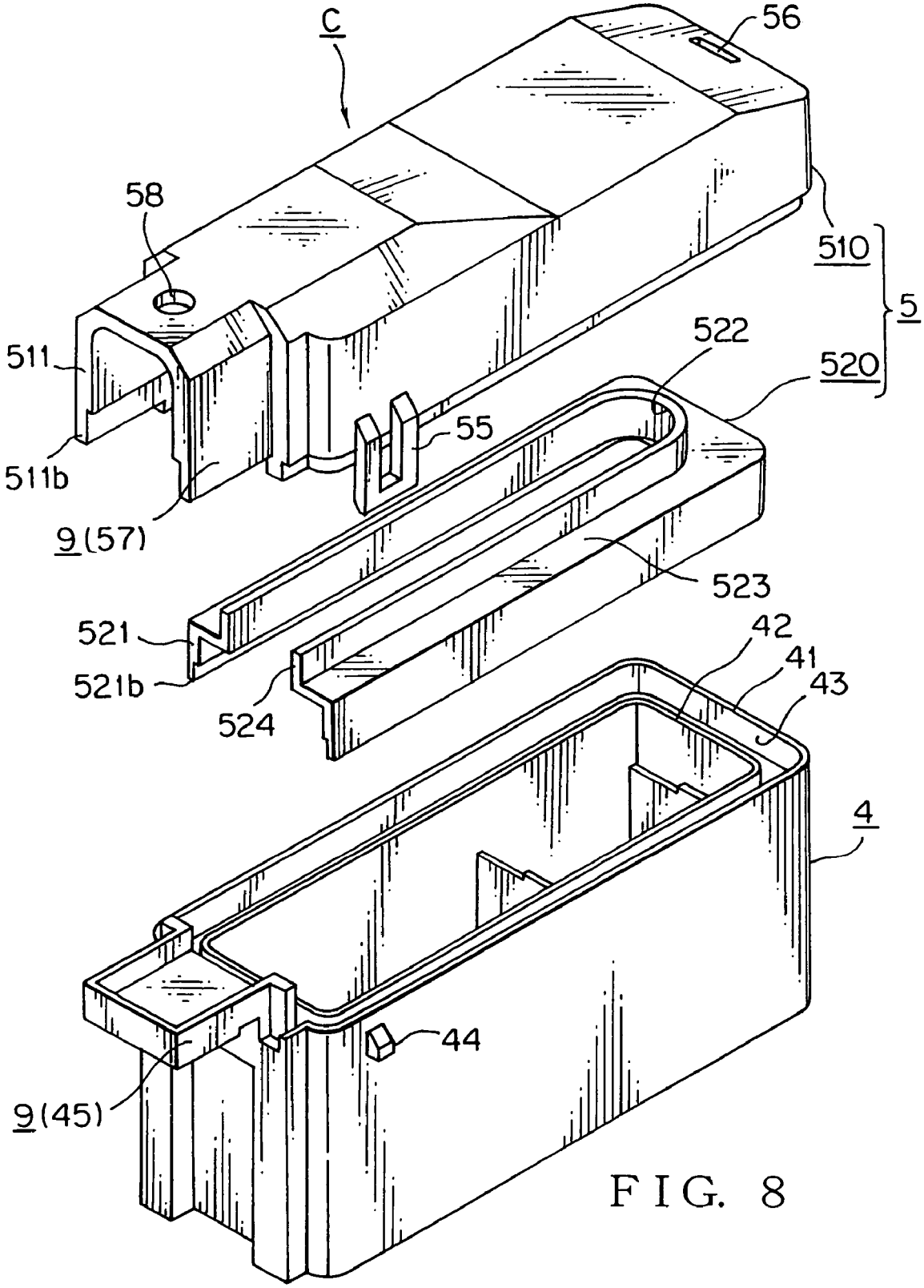
FIG. 8 is an exploded perspective view showing a connector of a second embodiment of the present invention.
Figure 9:
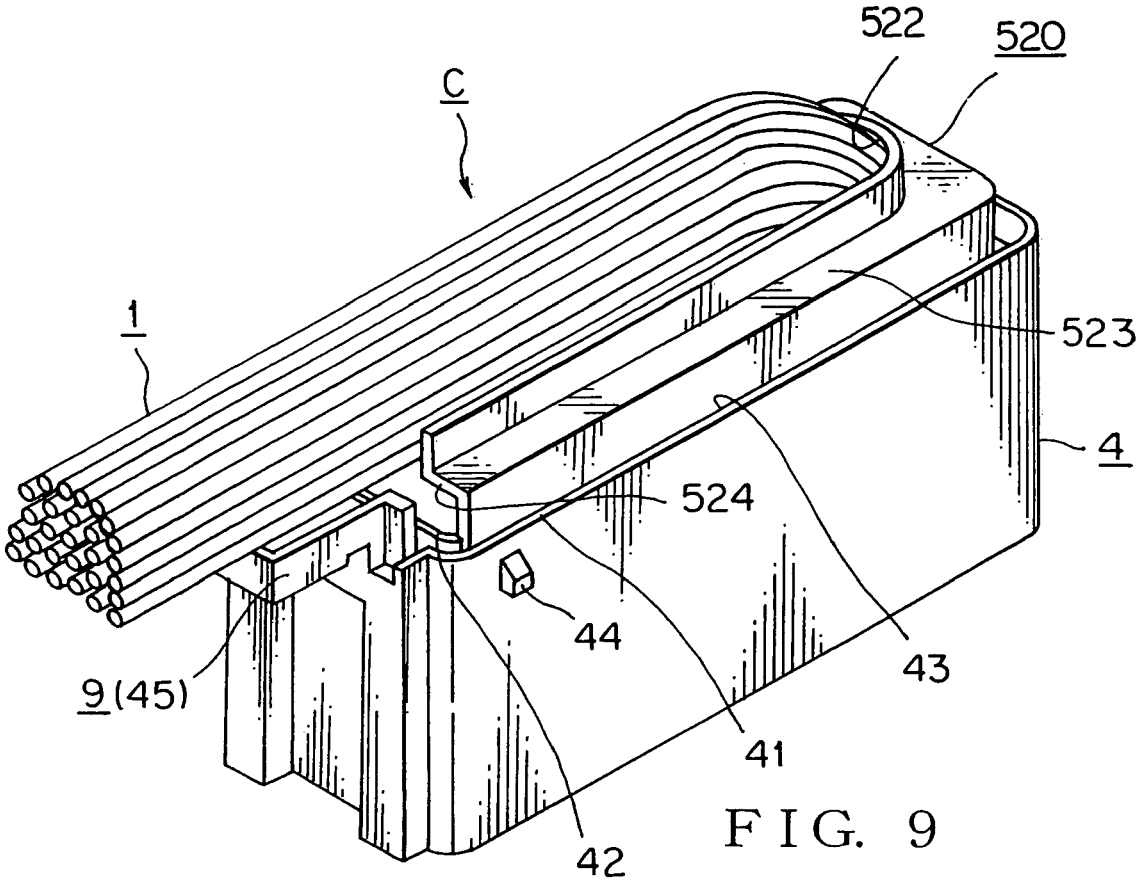
FIG. 9 is a perspective view showing the connector prior to an attachment of an outer cover to a housing of the connector.
Figure 10:
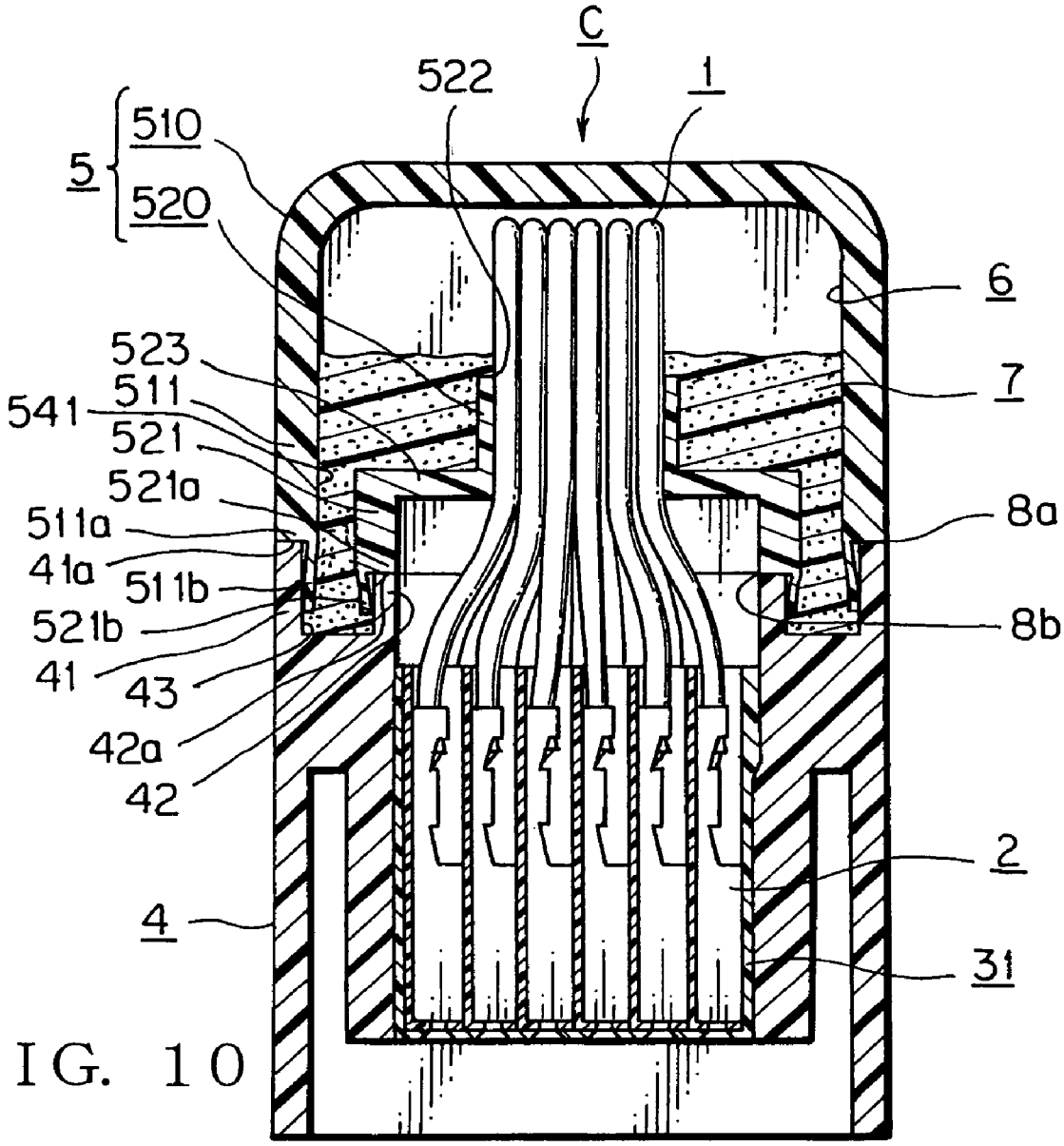
FIG. 10 is a vertical sectional view showing an assembling of the connector.

FIGS. 8–10 show a connector C of a second embodiment of the present invention. The like parts as the first embodiment are referred to the same reference signs and the explanation is omitted. In the second embodiment, a cover 5 has an outer cover 510 and inner cover 520.

The outer cover 510 is attached to a top end of a housing 4 and has a first cover wall 511. The first cover wall 511 engages with a first housing wall 41 forming a peripheral wall of the housing 4.

As shown in FIG. 10, the first cover wall 511 has a first step portion 511*a* at an end portion at a side of the housing 4 and a first thin end portion 511*b* extending from the first step portion 511*a*.

When the outer cover 510 is attached to the housing 4, the first step portion 511*a* of the first cover wall 511 abuts to a first end face 41*a* and the first thin end portion 511*b* of the first cover wall 511 enters into a housing groove 43 of the housing 4.

The inner cover 520 is received inside the outer cover 510 and formed to cover an opening of cavities 34 of a connector block 31 received in the housing 4. The inner cover 520 has a second cover wall 521 at an end thereof at the side of the housing 4.

As shown in FIG. 10, the inner cover 520 has a second step portion 521*a* at an end portion thereof in the side of the housing 4, and a second thin end portion 521*b* extending from the second step portion 521*a*.

When the inner cover 520 is attached to the housing 4, the second step portion 521*a* abuts to a second end face 42*a* of a second housing wall 42 and the second thin end portion 521*b* enters into the housing groove 43.

When the outer and inner covers 510 and 520 are attached to the housing 4, a cover groove 541 for injecting a filler 7 is formed between the outer and inner covers 510 and 520. Accordingly, the cover groove 541 and housing groove 43 are integrally formed to define a filling space 6 around the connector block 31 in the housing 4. The effervescent filler 7 is injected into the filling space 6.

The filler 7 expands inside the filling space 6 and presses the first thin end portion 511*b* toward the first housing wall 41 and the second thin end portion 521*b* toward the second housing wall 42. Accordingly, the first and second thin end portions 511*b* and 521*b* closely abut to the first and second housing walls 41 and 42, respectively.

Thereby, gaps formed between the first thin end portion 511*b* and the first housing wall 41 and between the second thin end portion 521*b* and the second housing wall 42 are closed. When the filler 7 hardens after a prescribed time, the connector C becomes watertight between the housing 4 and the inner and outer covers 510 and 520.

The first and second thin end portions 511*b* and 521*b* deform and abut to the first and second housing walls 41 and 42 so that the filler 7 is prevented from leaking through fitting faces 8*a* and 8*b* between the housing 4 and the outer and inner covers 510 and 520.

The inner cover 520 has an elongated opening 522 at a side of the outer cover 510 for leading electric wires 1 attached to terminals 2. The area of the elongated opening 522 is smaller than that of an opposed opening of the inner cover 520. The inner cover 520 has a step portion 523 disposed between the elongated opening 522 and an outer wall of the inner cover 520. As shown in FIG. 9, the bundle of the electric wires 1 connected to the terminals 2 received in the connector block 31 in the housing 4 is led out from the elongated opening 522.

The outer cover 510 is attached to the housing 4. The bundle of the electric wires 1 is led out from a lead-out hole 9*a* of a lead-out portion 9, which is formed with the housing 4 and the outer cover 510 and have a tube shape. An end portion 524 of the inner cover 520 at a side of the lead-out portion 9 is open for guiding the bundle of the electric wires 1 to the lead-out portion 9.

The filler 7 is injected into a cover 5 until the inner cover 520 is completely covered with the filler 7 as shown in FIG. 10 so that the filler 7 enters between the electric wires 1 in a vicinity of the elongated opening 522 and seals gaps between the electric wires 1.

The filler 7 hardens after the prescribed time so that the filler 7 does not enter into the connector block 31 through the gaps between the electric wires 1 in the vicinity of the elongated opening 522.

The assembling of the connector C is the same as that of the first embodiment until the terminals 2 are received in the connector block 31 of the housing 4. In this state, the inner cover 520 is attached to the housing 4 and the bundle of the electric wires 1 is led out from the elongated opening 522. The outer cover 510 is attached to the housing 4.

Accordingly, the first and second thin end portions 511*b* and 521*b* enter into the housing groove 43. The cover groove 541 and housing groove 43 are integrally formed and define the filling space 6 of the filler 7 around the connector block 31.

The effervescent filler 7, for example effervescent urethane resin, is injected through an injection hole 58 into the filling space 6.

Figure 11:
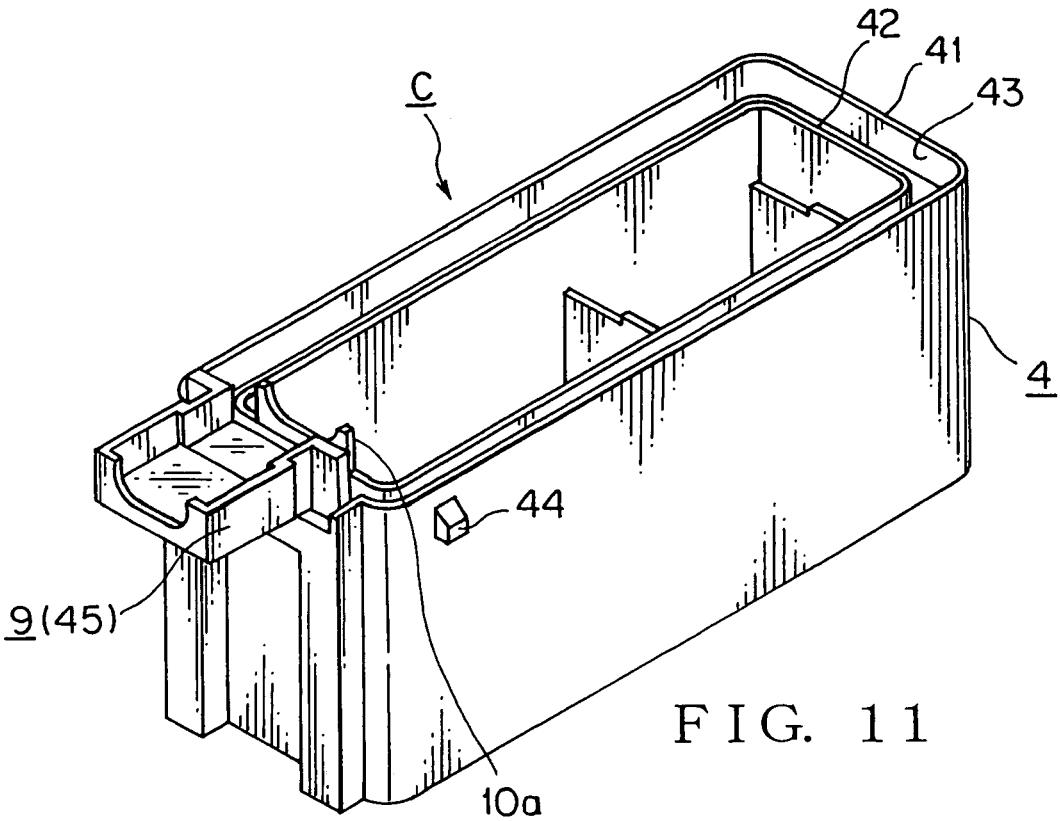
FIG. 11 is a perspective view showing especially a housing of a connector of a third embodiment of the present invention.
Figure 12:
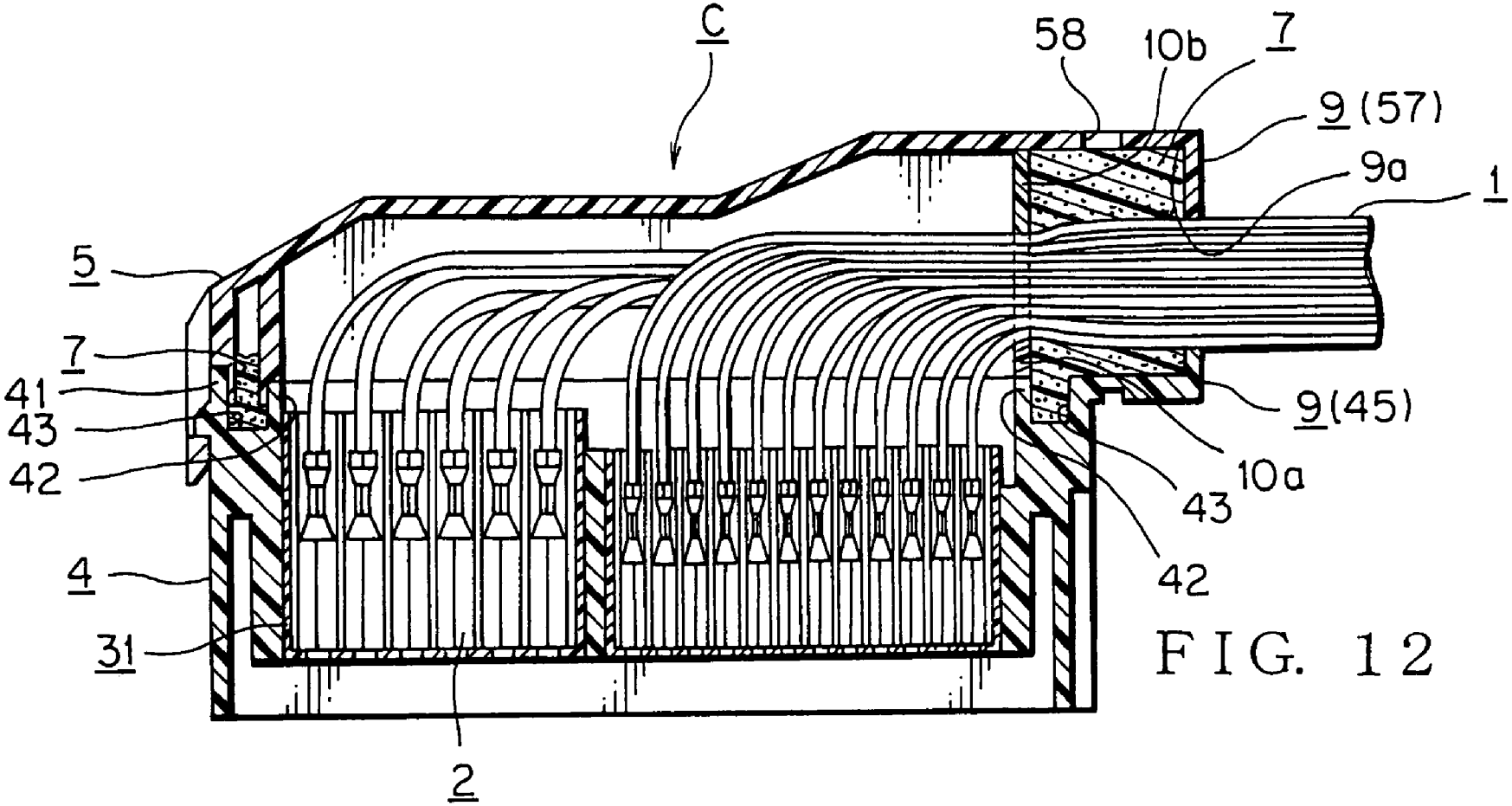
FIG. 12 is a vertical sectional view for illustrating an assembling of the connector.

FIGS. 11 and 12 show a connector C of a third embodiment of the present invention. The connector C has a housing wire holder 10*a* and a cover wire holder 10*b* for holding electric wires 1 led out from the connector C.

The bundle of the electric wires 1 connected to terminals 2 received in a connector block 31 is led out from a tube shaped lead-out portion 9 through a lead-out hole 9*a* to outside.

The lead-out portion 9 is disposed in the housing 4 and cover 5. The lead-out portion 9 has a supporting plate 45 extending from a first housing wall 41 and a U-shaped portion 57 extending from a first cover wall 51.

The housing wire holder 10*a* is disposed and upstanding at a second housing wall 42 of the housing 4 with facing to the led-out hole 9*a* for holding the electric wires 1. The cover wire holder 10*b* is disposed and upstanding at the corresponding position to the housing wire holder 10*a* with facing to the led-out hole 9*a* for holding the electric wires 1.

When the housing 4 and cover 5 are assembled, the bundle of the electric wires 1 are held from above and below with the housing and cover wire holders 10*a* and 10*b* and led out from the connector C through the lead-out hole 9*a*.

The electric wires 1 held with the housing and cover wire holders 10*a* and 10*b* become loose therebetween. The filler 7 is injected into the lead-out hole 9*a* through an injection hole 58 disposed in the lead-out portion 9. The filler 7 injected easily enters and effectively seals between the electric wires 1 and improves the watertight of the connector C.

The housing wire holder 10*a* upstanding at the second housing wall 42 prevents the filler 7 from entering into the connector block 31 disposed inside the second housing wall 42 so that the contact failure of the terminals 2 due to the filler 7 is avoided.

The filler 7 injected through the lead-out hole 9*a* keeps watertight between the cover 5 and housing 4. The filler 7 does not leak out of the fitting faces between the cover 5 and housing 4 even though the fitting faces have gaps.

The housing and cover wire holders 10*a* and 10*b* are integrally formed with the housing 4 and cover 5 but may be formed separately therefrom. When formed separately, the housing and cover wire holders 10*a* and 10*b* are formed with an resilient member such as rubber. The wire holders 10*a* and 10*b* of the resilient member are capable of accepting different diameters of the bundle of the electric wires 1 so that a gap between the electric wires 1 and the wire holders 10*a* and 10*b* is avoided. Accordingly, the filler 7 does not enter into the connector block 31 so that the contact failure of the terminals 2 due to the filler 7 is prevented.

The housing and cover wire holders 10*a* and 10*b* are disposed on the housing 4 and cover 5, respectively. The wire holder can be disposed on either of the housing 4 and cover 5.

In the third embodiment, the housing and cover wire holders 10*a* and 10*b* are disposed on the type of the connector C disclosed in the first embodiment. When the housing and cover wire holders 10*a* and 10*b* are disposed on the connector C of the second embodiment, the wire holder 10*b* is disposed on either of the outer cover 510 and inner cover 520.

The embodiments of the present invention are only exemplary and not limited thereto. Any modifications of the present invention are within the scope of the invention.

What is claimed is:

1. A connector comprising:

a housing receiving a connector block having a terminal receiver receiving a terminal; and a cover for covering an opening of the connector block when the cover is attached to the housing, wherein said housing has a housing groove formed, at a side of the cover, with a first housing wall and a second housing wall adjacent to the first housing wall, and said cover has a cover groove formed, at a side of the housing, with a first cover wall and a second cover wall adjacent to the first cover wall, and wherein when said cover is attached to the housing, a first and second end portions of the first and second walls of one of the cover and the housing enter into the groove of the other and form a filling space of a filler around the connector block of the housing, and the filler injected into the filling space expands with a liquid pressure and presses the first and second end portions of the one to deform and closely abut to the first and second walls of the other.

2. The connector as claimed in claim 1, wherein said cover has an outer cover and an inner cover, said outer cover is attached to a periphery of the housing and has the first cover wall, and the inner cover received in the outer cover covers the opening of the connector block and has the second cover wall and an opening for leading out an electric wire attached to the terminals, and wherein the filler is injected to cover fully the inner cover.

3. The connector as claimed in claim 1, wherein said housing and cover have respective housing and cover lead-out portions for leading out the electric wire attached to the terminals through a lead-out hole, at least one of the housing and cover lead-out portions has a wire holder upstanding at the second wall and facing to an inner side of the lead-out hole for holding the electric wire, and wherein the filler is injected through the lead-out hole.

4. The connector as claimed in claim 1, wherein said filler is an effervescent resin.

* * * * *